US011555474B2

(12) United States Patent
Casellas et al.

(10) Patent No.: US 11,555,474 B2
(45) Date of Patent: Jan. 17, 2023

(54) PIPE SECTION OF A COMMON RAIL LINE AND METHODS FOR MANUFACTURING SAME

(71) Applicant: GKN Sinter Metals Engineering GmbH, Radevormwald (DE)

(72) Inventors: Antonio Casellas, Siegburg (DE); Jack Schwarz, Gotha (DE); Wolfgang Schütz, Bad Tennstaed (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 0 days.

(21) Appl. No.: 17/373,206

(22) Filed: Jul. 12, 2021

(65) Prior Publication Data

US 2021/0404429 A1 Dec. 30, 2021

Related U.S. Application Data

(62) Division of application No. 16/490,971, filed as application No. PCT/EP2018/054457 on Feb. 23, 2018, now abandoned.

(30) Foreign Application Priority Data

Mar. 6, 2017 (DE) ..... 10 2017 104 608.9

(51) Int. Cl.
*F02M 55/02* (2006.01)
*B22F 3/115* (2006.01)
(Continued)

(52) U.S. Cl.
CPC ..... *F02M 55/025* (2013.01); *B22F 3/115* (2013.01); *F02M 55/005* (2013.01);
(Continued)

(58) Field of Classification Search
None
See application file for complete search history.

(56) References Cited

U.S. PATENT DOCUMENTS 4,163,561 A * 8/1979 Butler ..... F16L 41/10 138/140
4,832,376 A * 5/1989 Sugao ..... F16L 41/12 285/133.11

(Continued)

FOREIGN PATENT DOCUMENTS

CN 204921225 U 12/2015
CN 110462199 A * 11/2019 ..... B22F 3/115

(Continued)

OTHER PUBLICATIONS

PCT International Search Report, PCT/EP2018/054457, dated Jun. 1, 2018, 7 pages.

(Continued)

*Primary Examiner* — Kevin R Steckbauer
(74) *Attorney, Agent, or Firm* — Quarles & Brady LLP

(57) ABSTRACT

A pipe section of a common rail line is provided for the high-pressure injection of a fluid. The pipe section has at least a first pipe and an adapter in which the first pipe has a wall and extends at least along an axial direction. The wall has an inner circumferential surface and an outer circumferential surface and encloses a first line. The adapter has a connector piece and a second pipe. The connector piece extends annularly around the first pipe and is situated on the outer circumferential surface. A second line that is formed by the second pipe is fluidically connected to the first line via a first opening in the first pipe and a second opening in the connector piece. At least the adapter is manufactured by a metal powder injection molding process. Two methods for manufacturing a pipe section are also provided.

5 Claims, 2 Drawing Sheets

(51) Int. Cl.
*F02M 55/00* (2006.01)
*F02M 69/46* (2006.01)

(52) U.S. Cl.
CPC ... *F02M 69/465* (2013.01); *F02M 2200/8046* (2013.01); *F02M 2200/8061* (2013.01)

(56) References Cited

U.S. PATENT DOCUMENTS 4,900,180 A * 2/1990 Takikawa ..... F16L 41/14 285/133.11
4,953,896 A * 9/1990 Usui ..... F02M 55/005 285/333
5,120,084 A * 6/1992 Hashimoto ..... F16L 41/14 285/133.11
5,169,182 A * 12/1992 Hashimoto ..... B60K 15/01 285/353
5,261,705 A * 11/1993 Takahashi ..... F16L 33/00 285/332
6,408,826 B2 * 6/2002 Asada ..... B21C 37/29 123/456
7,213,577 B2 * 5/2007 Hummel ..... F02M 55/025 285/133.11
8,025,316 B2 * 9/2011 Sperle ..... F02M 61/168 285/233
8,186,721 B2 * 5/2012 Furukido ..... F16J 15/0812 277/610
8,602,420 B2 * 12/2013 Maeda ..... F01N 13/1811 277/650
8,918,982 B2 * 12/2014 Hagedorn ..... B21D 39/06 29/507
10,184,384 B2 * 1/2019 Kaida ..... F01N 13/16
2002/0005186 A1 * 1/2002 Asada ..... B21C 37/29 123/456
2010/0059994 A1 * 3/2010 Sperle ..... F02M 55/02 285/332.1
2010/0253011 A1 * 10/2010 Maeda ..... F01N 13/1811 277/626
2011/0041946 A1 * 2/2011 Hagedorn ..... B21C 37/154 29/516
2011/0049869 A1 * 3/2011 Furukido ..... F01N 13/1811 277/627
2013/0186371 A1 * 7/2013 Pascuzzi ..... F02M 55/025 123/456
2013/0187347 A1 * 7/2013 Kaida ..... F01N 13/1827 277/627
2016/0319787 A1 * 11/2016 Udagawa ..... F02M 55/004
2020/0025165 A1 * 1/2020 Casellas ..... F02M 55/025
2021/0404429 A1 * 12/2021 Casellas ..... B22F 3/115

FOREIGN PATENT DOCUMENTS

DE 10303853 A1 * 8/2004 ..... B21C 37/06
DE 102017104608 A1 * 9/2018 ..... B22F 3/115
EP 0668115 A1 8/1995
EP 3592968 A1 * 1/2020 ..... B22F 3/115
JP H03275907 A 12/1991
JP H05332221 A 12/1993
JP 2001221126 A 8/2001
JP 2001221126 A * 8/2001 ..... F02M 55/025
JP 2007056816 A * 3/2007 ..... B22F 3/115
JP 2007056816 A 3/2007
JP 2007085245 A * 4/2007 ..... F02M 55/025
JP 2007085245 A 4/2007
JP 2013177854 A * 9/2013 ..... F02M 55/025
JP 2013177854 A 9/2013
WO WO-2018162252 A1 * 9/2018 ..... B22F 3/115

OTHER PUBLICATIONS

PCT Written Opinion, PCT/EP2018/054457, dated Jun. 1, 2018, 12 pages.
European Patent Office, Examination Report, Application No. 18707683.1, dated Aug. 3, 2021, 5 pages [No English Language Translation Available].
State Intellectual Property Office of People's Republic of China, First Office Action and Search Report, Application No. 201880016724.1, dated Mar. 2, 2021, 16 pages.
National Intellectual Property Administration, P. R. China, Decision of Rejection and Supplementary Search Report, Application No. 201880016724.1, dated Nov. 18, 2021, 8 pages [English Language Translation of Supplementary Search Report Only].
Zhang et al., Practical Technology of Powder Metallurgy, Sep. 30, 2004, pp. 411-416 [No English Language Translation;cited as "A" reference in Decision of Rejection and Supplementary Search Report, Application No. 201880016724.1, dated Nov. 18, 2021].

* cited by examiner

PIPE SECTION OF A COMMON RAIL LINE AND METHODS FOR MANUFACTURING SAME

CROSS-REFERENCES TO RELATED APPLICATIONS

This application is a divisional patent application of U.S. patent application Ser. No. 16/490,971 filed on Sep. 4, 2019, which represents the U.S. national stage entry of International Application No. PCT/EP2018/054457 filed Feb. 23, 2018, which claims priority to German Patent Application No. 10 2017 104 608.9 filed Mar. 6, 2017, the disclosure of which is incorporated herein by reference in its entirety and for all purposes.

TECHNICAL FIELD

The present invention relates to a pipe section of a common rail line that is provided for the high-pressure injection of a fluid, and two methods for manufacturing a pipe section, in particular for manufacturing the proposed pipe section.

BACKGROUND

Common rail lines have been known for quite some time, in particular as part of injection systems for a fuel in internal combustion engines, in particular diesel engines. Common rail lines are acted on by high pressures, by means of which the fluid is transported into the combustion chambers of the internal combustion engine. Common rail lines are generally connected to multiple injection nozzles via which in particular multiple combustion chambers are supplied with fluid. Pressures of at least 200 bar, in particular at least 1000 bar, and preferably at least 2000 bar, are hereby achieved which act on the common rail line. It is essential to ensure continual seal-tightness of the common rail line.

A common rail line includes in particular at least a first pipe with a first line and one or more adapters, wherein each adapter fluidically connects one or more injection nozzles to the first line. Thus far, the first pipe and the adapters have typically been integrally joined to one another via brazing joints or weld joints. The strength and seal-tightness of the connection between the adapters and pipe are ensured by the brazing joint or the weld joint.

SUMMARY

The object of the invention, therefore, is to at least partially solve the problems with regard to the prior art, and in particular to provide a pipe section of a common rail line and a method for manufacturing a pipe section for which an integral connection of the adapter and the first pipe via a brazing or welding process is not necessary to ensure the strength of the connection on the one hand, and the seal-tightness of the connection on the other hand.

It is pointed out that the features individually stated in the dependent claims may be combined with one another in a technologically meaningful way, defining further embodiments of the invention. Furthermore, the features set forth in the claims are specified and explained in greater detail in the description, in which further preferred embodiments of the invention are described.

This object is achieved by a pipe section of a common rail line that is provided for the high-pressure injection of a fluid. The pipe section has at least a first pipe and an adapter. The first pipe has a wall and extends at least along an axial direction. The wall has an inner circumferential surface and an outer circumferential surface and encloses a first line. The adapter has a connector piece and a second pipe, wherein the connector piece extends annularly around the first pipe and is situated on the outer circumferential surface. A second line that is formed by the second pipe is fluidically connected to the first line via a first opening in the first pipe and a second opening in the connector piece. At least the adapter is manufactured by means of a metal powder injection molding process.

Metal powder injection molding (metal injection molding (MIM)) processes have been known for quite some time. The metal powder injection molding process comprises in particular at least the following steps: feedstock production, injection molding, debinding, and sintering. The sintered component may subsequently undergo aftertreatment. For the feedstock production, a fine metal powder, for example iron powder (and optionally additional other powdered additives, optionally nickel or chromium, etc.) is mixed with an organic binder to form a homogeneous mass which, analogously to plastic processing, may be processed in an injection molding process. This metal/plastic mixture is referred to as feedstock. In the subsequent injection molding, this feedstock in liquefied form (generally at elevated temperature) is injected into a closed mold, where as the result of targeted temperature control it initially completely fills the mold (cavity) and subsequently plasticizes. The resulting molded body (green compact) already has all typical geometric features of the finished component. In the subsequent debinding, after the green compact is removed from the injection molding machine the binder is removed in a two-step debinding process, resulting in a pure metallic component. The porous molded body remaining after the debinding, now referred to as a brown compact, is subjected to sintering at elevated temperature to form a component having the final geometric and mechanical properties.

In the common rail line, one or more injection nozzles are fluidically connected to the first line, in particular via each adapter.

According to one advantageous embodiment, the connector piece of the adapter together with the outer circumferential surface of the first pipe forms an at least force-fit connection.

Force-fit connections require a normal force on the surfaces to be joined together. Mutual displacement of these surfaces is prevented as long as the counterforce produced by the static friction is not exceeded.

For example, the adapter is manufactured by means of a metal powder injection molding process, the first pipe being manufactured independently from the adapter, optionally by other methods.

The sintered component, in the present case at least the adapter, has in particular a residual porosity of at most 5%, preferably at most 3%, and is gas-tight. During the sintering, the component shrinks by at least 10% and at most 20%, in particular between 12% and 16%.

In the present case, use is made of this shrinkage for establishing the force-fit connection. For this purpose, the required dimensions of the components, in particular the adapter and the connector piece, and in particular for the injection molding, are designed with consideration for the shrinkage during sintering.

Due to the shrinkage, a force-fit connection is formed between the adapter and the first pipe which ensures at least the required strength of the connection for the sintered assembly made up of the first pipe and the adapter.

In particular, the sintering of the adapter additionally results in an integral connection between the adapter and the first tube.

Integral connections refer to any connection for which the connection partners are held together by atomic or molecular forces. At the same time, they are nondetachable connections that can be separated only by destroying the connection means.

In particular, the adapter and the first pipe, in addition to the at least force-fit connection, are joined together at least by a form-fit connection. The form-fit connection is preferably used solely for aligning the components with one another during the manufacturing process. In particular, the required strength of the connection for the sintered assembly made up of the first pipe and the adapter is ensured solely by the at least force-fit (and optionally also integrally joined) connection.

Form-fit connections result from the mutual engagement of at least two connection partners. Thus, the connection partners cannot be separated, even without transmission of force or with intermittent transmission of force. In other words, in a form-fit connection one of the connection partners is in the path of the other.

According to one advantageous embodiment, the form-fit connection is formed by a projection on the adapter which encloses the second opening and extends into the first opening. In particular, the adapter may thus be pushed onto the first pipe prior to the sintering. The adapter may be positioned in a predetermined position with respect to the first pipe via the projection and the first opening. In particular, the maximum play between the projection and the first opening is at most 0.5 millimeter, preferably at most 0.2 millimeter, so that precise positioning may be ensured. The play is formed in particular by the different diameters of the projection and of the first opening. For play of at most 0.5 millimeter, the diameters differ at most by 0.5 millimeter.

In particular, the adapter and the first pipe are connected to one another in a fluid-tight manner via the outer circumferential surface, the fluid-tight seal being ensured solely via the force-fit (and additionally, integral) connection between the first pipe and the connector piece. This ensures that a fluid conveyed through the common rail line can flow into the second pipe only via the first opening and the second opening, thus preventing passage of the fluid via the force-fit connection.

According to another embodiment, the adapter and the first pipe are connected to one another in a fluid-tight manner via the outer circumferential surface, wherein the fluid-tight seal is ensured via the force-fit connection and also via an additional sealing means.

In particular, a brazing material that is applied in the area of the force-fit connection in particular prior to the sintering is used as an additional sealing means. By use of the brazing material, in particular only the sealing effect is ensured. Here as well, the majority of the required strength of the connection between the adapter and the first pipe is ensured in particular via the force-fit connection (or via the additional integral connection of the adapter and the first tube).

According to another particularly advantageous embodiment, the first pipe and the adapter are manufactured as a (joint, one-piece) assembly by means of a metal powder injection molding process, wherein the first pipe and the adapter are integrally joined together. The integral connection is formed due to the fact that during the injection molding, the first pipe and the adapter are already manufactured as a one-piece, integrally joined assembly.

Such an assembly manufactured in one piece has clear advantages with regard to the manufacturing process, since only one manufacturing process is used, and it is not necessary to first establish an at least force-fit, fluid-tight connection.

Furthermore, a method for manufacturing a pipe section of a common rail line that is provided for the high-pressure injection of a fluid is proposed, in particular for manufacturing the above-described pipe section. The method comprises at least the following steps:

a) Providing a first pipe, wherein the first pipe has a wall and extends at least along an axial direction; wherein the wall has an inner circumferential surface and an outer circumferential surface and encloses a first line;

b) Manufacturing at least one one-piece adapter by means of a metal powder injection molding process; wherein the adapter has a sleeve-like connector piece for accommodating the first pipe, and has a second pipe, wherein the adapter has a second opening;

c) Pushing the sleeve-like connector piece onto the first pipe so that the connector piece extends annularly around the first pipe, and forming an assembly;

d) Sintering the assembly; wherein the adapter with the sleeve-like connector piece is shrunk onto the outer circumferential surface of the first pipe, thus forming an at least force-fit connection (and optionally also an integral connection).

In particular, prior to step c) the first pipe has at least a first opening in the wall, wherein in step d) a second line that is formed by the second pipe is fluidically connected to the first line via the first opening in the first pipe and the second opening in the connector piece.

It is preferred that the adapter and the first pipe, in addition to the force-fit (and optionally also integral) connection, are connected to one another at least by a form-fit connection, wherein the form-fit connection is formed by a projection on the adapter that encloses the second opening; wherein in step c) the connector piece is situated on the first pipe in such a way that the projection extends into the first opening; wherein in step c) the projection is used for aligning the adapter with the first pipe.

According to one advantageous embodiment, prior to step d) a sealing means is applied in the area between the connector piece and the outer circumferential surface, the sealing means ensuring a fluid-tight seal of the connection between the adapter and the first pipe via the outer circumferential surface.

A further method for manufacturing a pipe section of a common rail line that is provided for the high-pressure injection of a fluid is proposed, in particular for manufacturing the above-described pipe section having a one-piece design. The method comprises at least the following steps:

(1) Manufacturing the pipe section, having at least a first pipe and an adapter as a one-piece assembly, by means of a metal powder injection molding process; wherein the first pipe has a wall and extends at least along an axial direction; wherein the wall has an inner circumferential surface and an outer circumferential surface and encloses a first line; wherein the adapter has a connector piece and a second pipe; wherein the connector piece extends annularly around the first pipe; wherein a second line that is formed by the second pipe is fluidically connected to the first line via a first opening in the first pipe and a second opening in the connector piece;

(2) Sintering the assembly.

The statements concerning the pipe section similarly apply for the proposed methods, and vice versa.

As a precaution, it is noted that the ordinal numbers used herein ("first," "second," "third," . . . ) are used primarily (only) to distinguish between multiple objects, variables, or processes; i.e., in particular no dependency and/or sequence of these objects, variables, or processes relative to one another are/is necessarily specified. If a dependency and/or sequence is necessary, this is explicitly indicated herein, or is readily apparent to those skilled in the study of the embodiment specifically described.

BRIEF DESCRIPTION OF THE DRAWINGS

The invention and the technical field are explained in greater detail below with reference to the figures. It is pointed out that the invention is not to be construed as being limited by the illustrated exemplary embodiments. In particular, unless explicitly stated otherwise, it is also possible to extract partial aspects of the information shown in the figures and combine them with other components and findings from the present description and/or figures. Identical objects are denoted by the same reference numerals, so that explanations concerning other figures may possibly be supplementally used. The figures schematically show the following.

DETAILED DESCRIPTION

Figure 1:
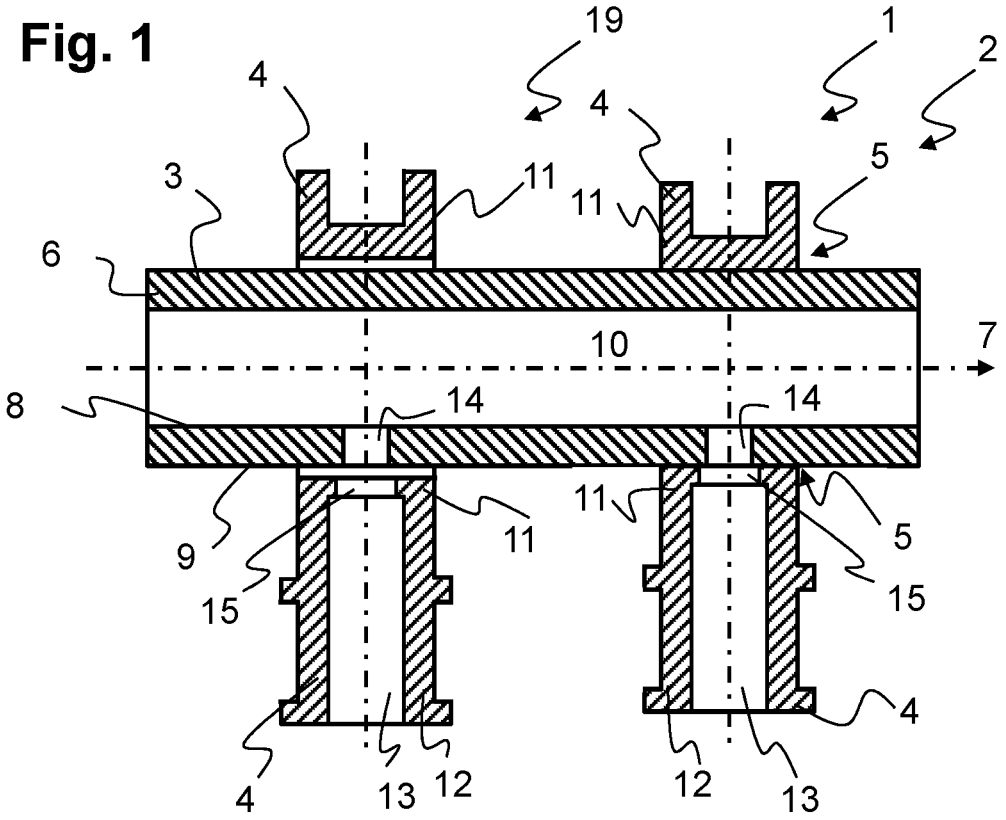
FIG. 1 shows a first embodiment variant of a pipe section in a cross-sectional side view.

FIG. 1 shows a first embodiment variant of a pipe section 1 in a cross-sectional side view. The pipe section 1 has a first pipe 3 and an adapter 4. The first pipe 3 has a wall 6 and extends at least along an axial direction 7. The wall 6 has an inner circumferential surface 8 and an outer circumferential surface 9 and encloses a first line 10. The adapter 4 has a connector piece 11 and a second pipe 12, wherein the connector piece 11 extends annularly around the first pipe 3 and is situated on the outer circumferential surface 9. A second line 13 formed by the second pipe 12 is fluidically connected to the first line 10 via a first opening 14 in the first pipe 3 and a second opening 15 in the connector piece 11. The adapter 4 is manufactured by means of a metal powder injection molding process.

FIG. 1 also illustrates the method for manufacturing the pipe section 1 of a common rail line 2. The first pipe 3 is provided according to step a). A one-piece adapter 4 is manufactured by means of a metal powder injection molding process and provided according to step b) (see the left illustration of the adapter 4). In step c) the adapter 4 with the sleeve-like connector piece 11 is pushed onto the first pipe 3 so that the connector piece 11 extends annularly around the first pipe 3 and forms an assembly 19 (see the left illustration in FIG. 1). The assembly 19 is sintered in step d), wherein the adapter 4 with the sleeve-like connector piece 11 is shrunk onto the outer circumferential surface 9 of the first pipe 3, thus forming a force-fit connection 5 (and optionally also an integral connection) (see the right illustration in FIG. 1).

Prior to step c), the first pipe 3 has a first opening 14 in the wall 6, wherein in step d) a second line 13 that is formed by the second pipe 12 is fluidically connected to the first line 10 via the first opening 14 in the first pipe 3 and the second opening 15 in the connector piece 11.

The adapter 4 and the first pipe 3 are connected to one another in a fluid-tight manner via the outer circumferential surface 9, the fluid-tight seal being ensured solely via the force-fit (and optionally also integral) connection 5 between the first pipe 3 and the connector piece 11. This ensures that a fluid conveyed through the common rail line can flow into the second pipe 12 only via the first opening 14 and the second opening 15, thus preventing passage of the fluid via the force-fit (and optionally also integral) connection 5 (see the right illustration in FIG. 1).

FIG. 1 may additionally be used to illustrate the pipe section 1 that is manufactured in one piece. The right illustration of the pipe section 1 in FIG. 1 shows that the first pipe 3 and the adapter 4 are manufactured as a (joint, one-piece) assembly by means of a metal powder injection molding process, wherein the first pipe 3 and the adapter 4 are integrally joined together. The integral connection is formed due to the fact that during the injection molding, the first pipe 3 and the adapter 4 are already manufactured as a one-piece, integrally joined assembly 19. The indicated separating lines between the adapter 4 and the first pipe 3 illustrate only the individually described components (adapter 4 and first pipe 3), which in fact have a joint one-piece design without a noticeable separation in the structure.

Figure 2:
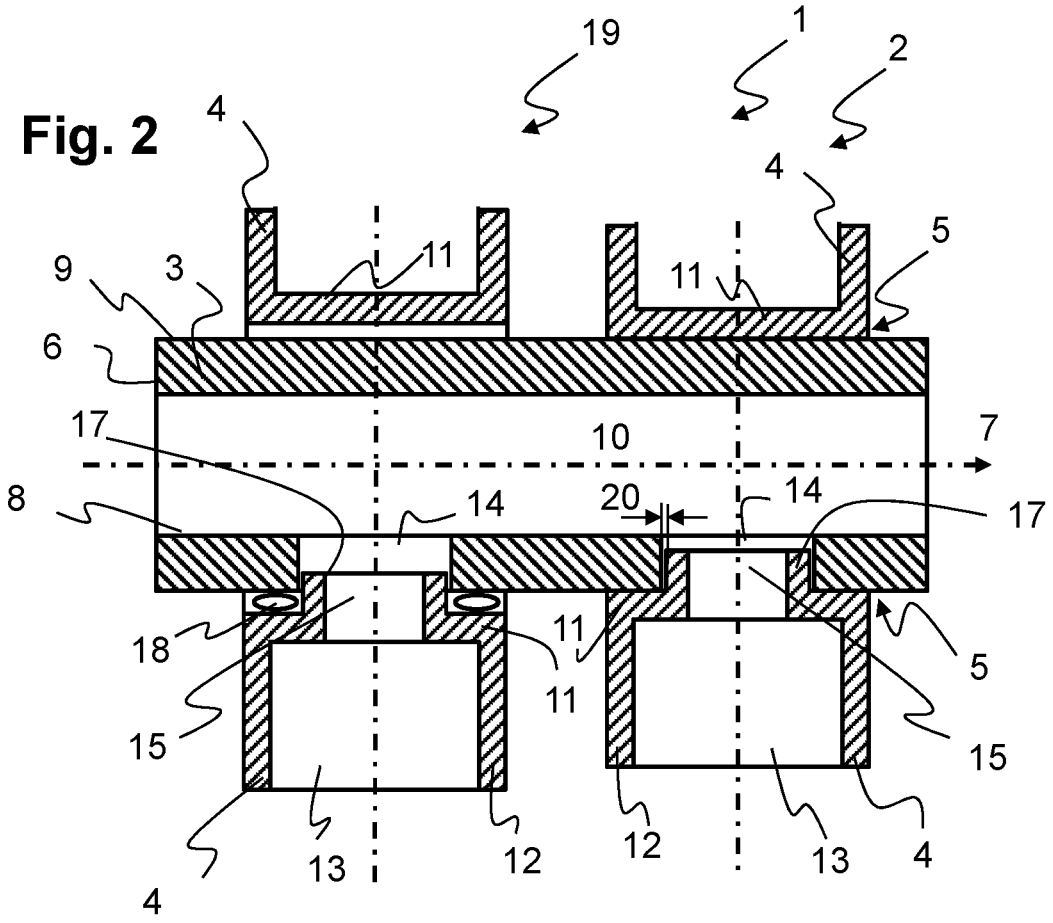
FIG. 2 shows a second embodiment variant of a pipe section in a cross-sectional side view.

FIG. 2 shows a second embodiment variant of a pipe section 1 in a cross-sectional side view. Reference is made to the discussion for FIG. 1. In contrast to FIG. 1, in this case the adapter 4 and the first pipe 3, in addition to the force-fit (and optionally also integral) connection 5, are joined together at least by a form-fit connection 16. The form-fit connection 16 is used solely for aligning the components (first pipe 3, adapter 4) with one another during the manufacturing process. The required strength of the connection for the sintered assembly 19, made up of the first pipe 3 and the adapter 4, is ensured solely by the force-fit (and optionally also integral) connection 5.

The form-fit connection 16 is formed by a projection 17 on the adapter 4 that encloses the second opening 15 and extends into the first opening 14. The adapter 4 may be pushed onto the first pipe 3 prior to the sintering (see the left illustration of the adapter 4). The adapter 4 may be positioned in a predetermined position with respect to the first pipe 3 via the projection 17 and the first opening 14. For this purpose, there is play 20 (a clearance fit) between the projection 17 and the first opening 14 so that precise positioning may be ensured.

The second embodiment variant additionally differs by the following feature: In this case the adapter 4 and the first pipe 3 are joined together in a fluid-tight manner via the outer circumferential surface 9, the fluid-tight seal being ensured via the force-fit (and optionally also integral) connection 5, as well as via an additional sealing means 18.

A brazing material that is applied in the area of the force-fit connection 5 prior to the sintering is used as an additional sealing means 18 (see the left illustration of the pipe section 1). By use of the brazing material, only the sealing effect is ensured. Here as well, the majority of the required strength of the connection between the adapter 4 and the first pipe 3 is ensured via the force-fit (and optionally also integral) connection 5.

LIST OF REFERENCE NUMERALS

1 pipe section
2 common rail line
3 first pipe
4 adapter
5 force-fit connection

6 wall
7 axial direction
8 inner circumferential surface
9 outer circumferential surface
10 first line
11 connector piece
12 second pipe
13 second line
14 first opening
15 second opening
16 form-fit connection
17 projection
18 sealing means
19 assembly
20 play

The invention claimed is:

1. A method for manufacturing a pipe section of a common rail line that is provided for the high-pressure injection of a fluid, at least comprising the following steps:

a) Providing a first pipe, wherein the first pipe has a wall and extends at least along an axial direction; wherein the wall has an inner circumferential surface and an outer circumferential surface and encloses a first line;

b) Manufacturing at least one one-piece adapter by a metal powder injection molding process; wherein the adapter has a sleeve-like connector piece for accommodating the first pipe, and has a second pipe;

c) Pushing the sleeve-like connector piece onto the first pipe so that the connector piece extends annularly around the first pipe, and forming an assembly;

d) Sintering the assembly; wherein the adapter with the sleeve-like connector piece is shrunk onto the outer circumferential surface of the first pipe, thus forming an at least force-fit connections;

wherein the adapter and the first pipe, in addition to the force-fit connection, are connected to one another at least by a form-fit connection, wherein the form-fit connection is formed by a projection on the adapter that encloses a second opening of the connector piece; wherein in step c) the connector piece is situated on the first pipe in such a way that the projection extends into a first opening in the wall of the first pipe; wherein in step c) the projection is used for aligning the adapter with the first pipe.

2. The method according to claim 1, wherein in step d) a second line that is formed by the second pipe is fluidically connected to the first line via the first opening in the first pipe and the second opening in the connector piece.

3. A method for manufacturing a pipe section of a common rail line that is provided for the high-pressure injection of a fluid, at least comprising the following steps:

a) Providing a first pipe, wherein the first pipe has a wall and extends at least along an axial direction; wherein the wall has an inner circumferential surface and an outer circumferential surface and encloses a first line;

b) Manufacturing at least one one-piece adapter by a metal powder injection molding process; wherein the adapter has a sleeve-like connector piece for accommodating the first pipe, and has a second pipe;

c) Pushing the sleeve-like connector piece onto the first pipe so that the connector piece extends annularly around the first pipe, and forming an assembly;

d) Sintering the assembly; wherein the adapter with the sleeve-like connector piece is shrunk onto the outer circumferential surface of the first pipe, thus forming an at least force-fit connections;

wherein prior to step d) a seal is applied in the area between the connector piece and the outer circumferential surface, the seal ensuring a fluid-tight seal of the connection between the adapter and the first pipe via the outer circumferential surface.

4. A method for manufacturing a pipe section of a common rail line that is provided for the high-pressure injection of a fluid, comprising the following sequential steps:

a) Manufacturing the pipe section, having at least a first pipe and an adapter as a one-piece assembly, by a metal powder injection molding process; wherein the first pipe has a wall and extends at least along an axial direction; wherein the wall has an inner circumferential surface and an outer circumferential surface and encloses a first line;

wherein the adapter has a connector piece and a second pipe; wherein the connector piece extends annularly around the first pipe; wherein a second line that is formed by the second pipe is fluidically connected to the first line via a first opening in the first pipe and a second opening in the connector piece;

b) sintering the assembly as manufactured.

5. The method of claim 4, wherein the one-piece assembly as manufactured has no noticeable separation in the structure as the first pipe and the adapter are integrally joined together by the metal powder injection molding process.

* * * * *